US005749765A

United States Patent [19]

Stopperan

[11] Patent Number: 5,749,765

[45] Date of Patent: May 12, 1998

[54] PINWHEELS FOR PLAYGROUND EQUIPMENT

[76] Inventor: Jahn Stopperan, 16145 Hyland Ave. South, Lakeville, Minn. 55044

[21] Appl. No.: 664,534

[22] Filed: Jun. 17, 1996

[51] Int. Cl.[6] ..... A63H 33/40

[52] U.S. Cl. ..... 446/217; 446/71; 24/5

[58] Field of Search ..... 446/16, 18, 217, 446/218, 71; 24/5, 115 A, 710.5

[56] References Cited

U.S. PATENT DOCUMENTS

| | | | |
|---|---|---|---|
| D. 165,593 | 1/1952 | Low . | |
| D. 205,232 | 7/1966 | Golub . | |
| 571,449 | 11/1896 | Laube . | |
| 1,134,417 | 4/1915 | Pole . | |
| 1,466,031 | 8/1923 | Rippin . | |
| 1,557,498 | 10/1925 | Looney | 472/118 |
| 1,578,450 | 3/1926 | Levander . | |
| 2,373,499 | 4/1945 | Passanante | 446/217 |
| 4,031,656 | 6/1977 | Kupperman et al. . | |
| 4,120,561 | 10/1978 | Burkholder | 350/99 |
| 4,559,675 | 12/1985 | Devenny | 24/5 |
| 5,014,641 | 5/1991 | Johnson | 116/28 R |
| 5,197,926 | 3/1993 | Cunard | 472/118 |
| 5,216,780 | 6/1993 | Lutzke et al. | 16/111 R |
| 5,337,449 | 8/1994 | Lutzke | 16/111 R |
| 5,348,507 | 9/1994 | McGhie et al. | 446/16 |
| 5,368,515 | 11/1994 | Mast | 446/217 |

FOREIGN PATENT DOCUMENTS

| | | | |
|---|---|---|---|
| 5167 | 2/1888 | United Kingdom | 24/5 |

*Primary Examiner*—Robert A. Hafer
*Assistant Examiner*—Jeffrey D. Carlson
*Attorney, Agent, or Firm*—Haugen and Nikolai, P.A.

[57] ABSTRACT

An improved mounting bracket arrangement for rotatable pinwheel devices activated by a moving air stream. The bracket has substantially universal application to a variety of conveniently available mounting surfaces such as chains, ropes and cables used for swing suspension, as well as on the handlebars of bicycles and tricycles. The mounting bracket includes a base mounting member together with a resilient strap to complete the closure. The mounting bracket arrangement is essentially free of sharp or pointed surfaces.

10 Claims, 2 Drawing Sheets

10
15
15
11
15
15
16
26

11
15
15
16

PINWHEELS FOR PLAYGROUND EQUIPMENT

CROSS-REFERENCE TO RELATED APPLICATION

The present application is a utility application incorporating the subject matter of Disclosure Document No. 369, 399, filed Feb. 6, 1995 and entitled "PIN-WHEELS FOR PLAYGROUND EQUIPMENT".

BACKGROUND OF THE INVENTION

The present invention relates generally to an improved mounting bracket arrangement for rotatable pinwheel devices, or similar devices activated by a stream of moving air, and more particularly to a mounting system and bracket for such devices which has generally universal application to a variety of mounting surfaces. In the past, various pinwheel devices have been developed and utilized, and are popular for use in combination with toys such as bicycles and tricycles, as well as other moving conveyances. Although swings have been suggested as a popular support for this type of rotatable device, their practical application has been generally absent.

In the past, various systems have been developed for mounting pinwheels on various mounting surfaces, however they have generally been cumbersome, complex, or otherwise provided limited applicability. The present arrangement, by contrast, provides a substantially universal mount which does not interfere with the operation of the pinwheel device, and which is reliable, durable and safe for use by children. In addition to its adaptability for use in combination with various mounting surfaces, the mounting device of the present invention permits pinwheels to be conveniently held in virtually any operating position while at the same time being securely mounted for reliable retention. The mounting device is free of sharp or pointed surfaces, and hence may be utilized in areas frequented by young children.

As indicated, prior pinwheel mounting devices have been utilized, but suffer from the disadvantage of being complex and requiring expensive molds for preparation of the components. By contrast, the mounting apparatus of the present invention includes a generally universally adaptable resilient strap structure along with an attachment bracket designed with a cavity or means for capturing a rigid mounting member, with the backing member having a configuration which permits ease of molding, and at the same time, provides substantial advantages in substantially universal application.

SUMMARY OF THE INVENTION

Briefly, in accordance with the present invention, a mounting system for rotatable pinwheels or other similar apparatus activated by a stream of moving air is provided. Typically, rotatable pinwheels are mounted for rotation on a pinwheel shaft, with the shaft either serving as a support or being coupled to the distal end of a support post which may in turn be held in one's hand or stuck into the ground. Fastener means are provided in accordance with the present invention for joining the support post to a base member which is, in turn, normally movable in the ambient air. The fastener means comprises a backup pad having a surface adapted to mate with a base mounting surface available on the device upon which the fastener is mounted. The fastener means may comprise an open generally "C"-shaped arcuate pad with either an arcuate "C" channel, a planar "V" channel, or otherwise have rounded or flat contact surfaces. The arcuate pad further includes a plurality of outwardly extending radially strap engaging members which are utilized for secure engagement with a resilient flexible locking strap. By way of example, the pad may provide two or more outwardly extending radially positioned strap retaining projections with symmetrically positioned radially extending ears being one preferred arrangement. The resilient flexible locking strap may be in the form of a rectangle or other configuration, with projection-engaging means or openings being formed adjacent the edges and adapted to be coupled across the edges of the backup pad. In this configuration, the flexible strap engages the backup pad and captures the mounting surface therewithin, and permits substantially universal mounting of the device onto any suitable mounting member. Additionally, the backup pad includes a means for receiving, capturing or otherwise retaining the support post for the pinwheel device, with a socket of appropriate diameter being one preferred form. With this type of mount being available, the mounting pad of the present invention provides for substantially universal application of the pinwheel to any of a host of suitable mounting surfaces.

As has been indicated, a "C"-shape allows for solid mounting against a round or other configuration which is other than flat. It is preferable to have a form of "shaped" surface available such as a "C" slot or a "V" slot in order that the strap mechanism be able to envelope the mounting member and surface therewithin. Also, the strap is designed to engage the backup pad and be retained thereon. Extending ears or other projections are appropriate to accomplish this feature.

As has been indicated, one of the preferred uses of pinwheel devices is for attachment to toys such as bicycles and tricycles. The handlebars of either provides a desirable mounting surface, and the circular cross-section of this component renders it highly suited for an attachment surface for pinwheels. The chain and/or cable suspensions of swings also provide desirable mounting or attachment surfaces.

Therefore, it is a primary object of the present invention to provide an improved rotatable pinwheel mounting arrangement which is substantially universal in scope, and which permits a pinwheel device to be mounted on a surface in virtually any disposition so as to permit rotation of the pinwheel without interference from the mounting device.

It is yet a further object of the present invention to provide an improved mount for a rotatable pinwheel device which is simple and straightforward in its design and configuration, and which is reliable, durable and is free of exposed sharp edges.

Other and further objects of the present invention will become apparent to those skilled in the art upon a study of the following specification, appended claims, and accompanying drawings.

IN THE DRAWINGS

Figure 1:
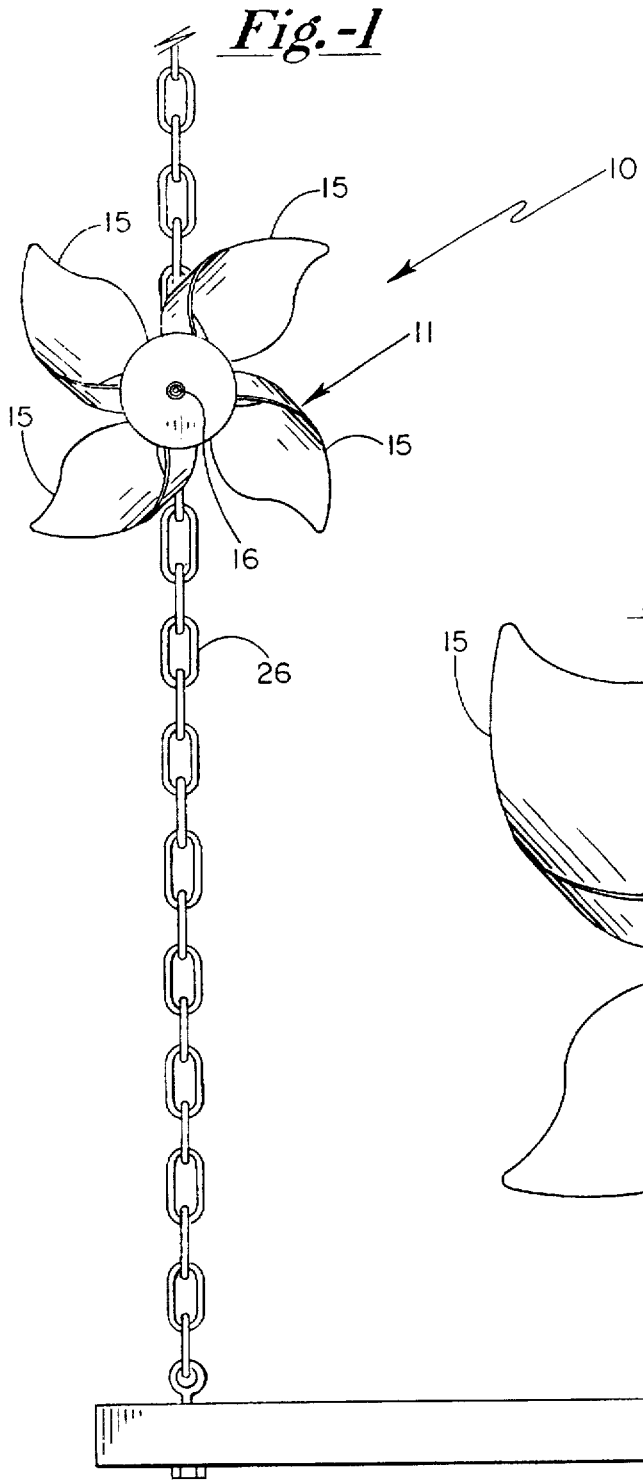
FIG. 1 is a front elevational view, partially broken away, and illustrating a rotatable pinwheel device secured to the chain of a swing device by the mounting bracket arrangement of the present invention, with the details of the bracket being partially obscured.
Figure 2:
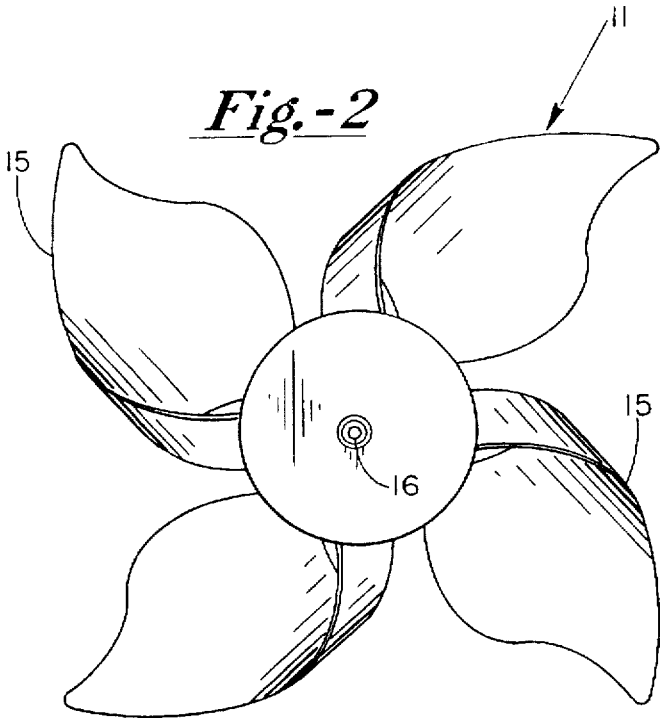
FIG. 2 is a front elevational view of a pinwheel device adapted for use in connection with the improved mounting arrangement of the present invention.
Figure 3:
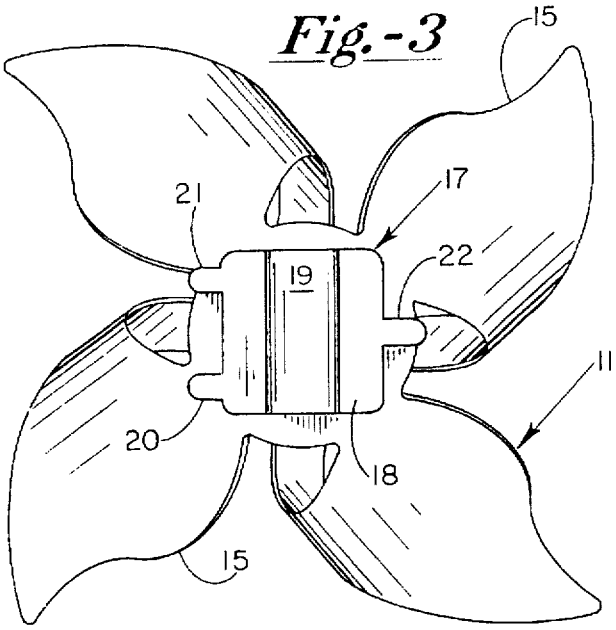
FIG. 3 is a rear elevational view similar to that of FIG. 2, and with the mounting bracket of the mounting device of the present invention coupled to the pinwheel shaft.
Figure 4:
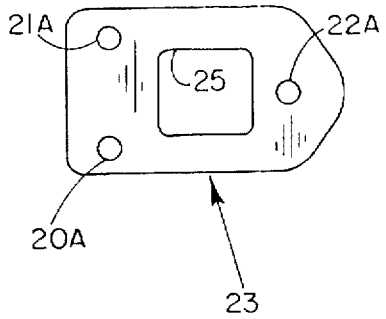
Figure 5:
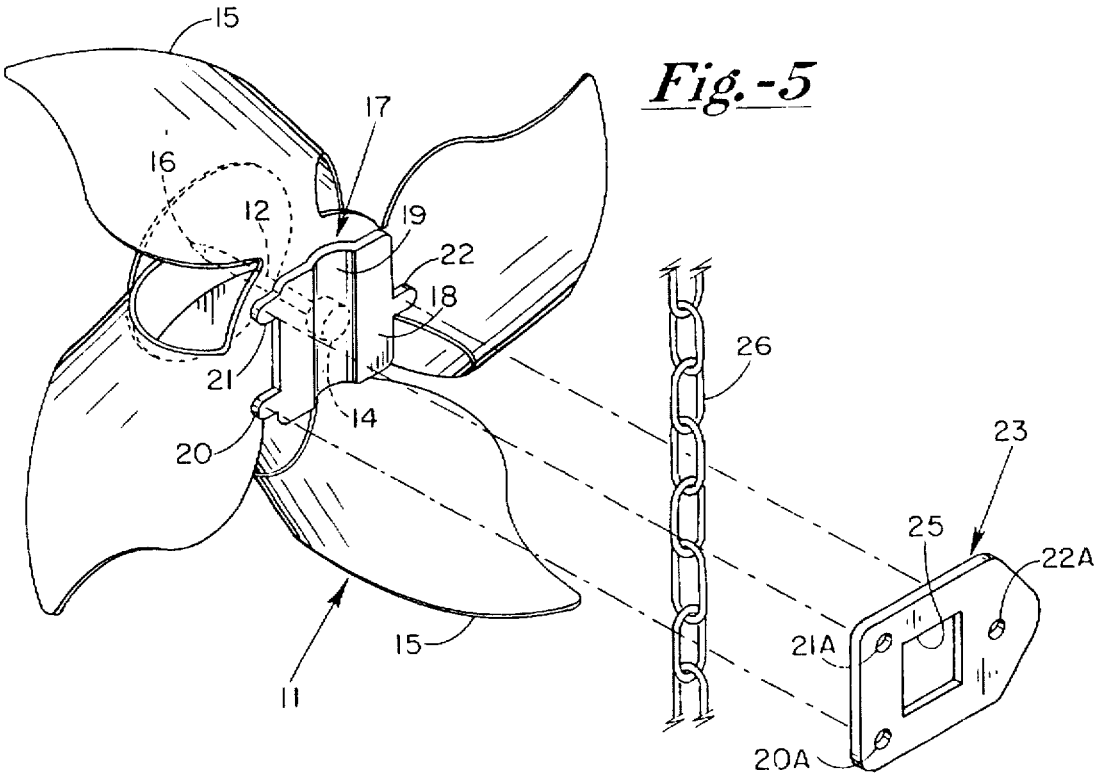

FIG. 4 is a front elevational view of the resilient flexible locking strap portion of the fastener means arranged for blocking engagement with the bracket member illustrated in FIG. 3; and FIG. 5 is a perspective view of the assembly illustrated in FIG. 1, and further illustrating, in exploded view, the manner in which the base bracket means and resilient flexible locking strap engage one another in operable position.

DESCRIPTION OF THE PREFERRED EMBODIMENT

With attention now being directed to the drawings, the rotatable pinwheel assembly generally designated 10 includes a rotatable pinwheel 11 mounted for rotation on a pinwheel shaft 12, with the pinwheel being arranged for activation in a stream of moving air. The pinwheel shaft 12 is coupled at its distal end 13 to a support post or base fastener socket, receptacle or boss 14. The fastener 14 is discussed in greater detail hereinbelow.

Pinwheel 11 includes a plurality of blades or flutes 15—15, each of which is configured to cause motion when exposed to a stream of moving air, with the combined arrangement of the individual blades 15—15 providing for rotation of the overall pinwheel when exposed to a stream of moving air.

With attention now being directed to FIGS. 3, 4 and 5 of the drawings, the fastener means generally designated 17 includes a base bracket means 18 which is in the form of an arcuate pad having an inner concave surface as at 19. The inner concave surface 19 is designed to contact a member such as a chain, handlebar, shafts, or the like upon which the assembly is attached. Base bracket 17 has a plurality of radially extending ears as at 20, 21, and 22 designed for locking engagement with matching bores 20A, 21A and 22A of resilient flexible locking strap 23. Each of the ears 20, 21 and 22 extend radially from inner concave base surface 19 to provide for firm locking engagement with flexible locking strap 23.

Flexible locking strap 23 may be in any suitable configuration, it being important that the locking strap include means for attachment to projections available on the base bracket. One highly suited configuration for the locking strap 23 is in the form of a generally rectangular sheet. In order to provide for appropriate elasticity and strength, an opening may be formed in the strap 23 as at 25. When employed, opening 25 is designed to reduce the amount of force required to stretch locking strap 23 into ultimate engagement with projections on member 17. Openings 20A, 21A and 22A are provided adjacent the edges of the resilient flexible rectangular sheet 23 in order to permit coupling across the edges of the arcuate pad, thereby closing the opening of the pad about the retainer object such as a chain or the like (see link chain 26, FIGS. 1 and 5).

Alternatively, the resilient strap may be in a slotted triangular configuration or provided with symmetrically arranged projections such as single ears disposed one at each end of the bracket. Symmetrically arranged single ears have the advantage of enabling a single parting line of the mold, and hence facilitate ease and cost reduction in the molding operation.

Mounting boss means are provided at 14 to retainably receive the distal end 13 of pinwheel shaft 12. Mounting boss 14 is preferably integral with the concave base member 19. Mounting boss 14 is positioned on the convex outer surface and, as indicated, is designed to retainably receive the support post or pinwheel shaft 12 therewithin.

For purposes of appropriate ease of handling and mounting, resilient flexible locking strap 23 is preferably prepared from a rubber material having a durometer of between 45 and 55. Such material is available in various thicknesses from Arrow Rubber Company, Inc. of Bridgeview, Ill. under the trade designation "EPDM", with 1/16th-inch thick stock being appropriately and advantageously utilized in connection with the present invention. In addition to its resiliency, the material is appropriate for resistance to weather and exposure to outdoor ultraviolet light. Alternatively, synthetic rubbers fabricated of silicone may provide good resiliency and high durability and weathering characteristics and properties. Other rubber materials may be found suitable as well.

The design of the hole pattern in resilient flexible locking strap 23 is selected to provide enough flexibility to permit the device to be pulled and hooked, and remain in place during periods of exposure to shock loading and the like. The concave nature of member 19 is designed to provide good seating against a curved receiver, such as the handlebar of a bicycle or tricycle, or chain or rope for conventional swings, fences, railings, strollers, and the like.

The design of the retainer is such that a single production part can be molded as a single and one-piece unit using a material which is free of sharp points, and yet is sufficiently durable for use in this application. High density polyethylene and/or polypropylene as well as other suitable polymers or copolymers may be selected for this application.

The head of the pinwheel shaft is shown at 16. This head is designed to be retained on a pinwheel shaft with the shaft having a diameter to accept existing pinwheels which are commercially available. Other various diameters and designs can, of course, be appropriately applied and utilized. One typical design is that of a conical configuration, although hemispherical designs may be employed as well.

The mounting arrangement including the fastener socket or boss and the resilient flexible locking strap are designed so as to avoid interference with the spinning action of the pinwheel. The stand-off portion of the boss at the base of the shaft prevents such interference. The overall length of the resilient flexible locking strap may be adjusted to accommodate various mounting unit circumferences, it being sufficient to provide a locking strap which is sufficiently resilient to permit its use and application for mounting pinwheels on any desired object by younger individuals including children.

It will be noted that bracket member which includes concave cavity 19 can be mounted in any position relative to the pinwheel, including horizontal as well as vertical or tilted angular mounting. The resilient flexible locking strap may be utilized and installed even in wet conditions, it being noted that the overall application provides enough friction to prevent slipping.

It will also be noted that the current flexible locking strap 23 has a pair of mounting bores on one side and a single locking bore on the other for hooking. The design permits the utilization of the larger hole to enable the locking strap to be stretched and mounted into place. The utilization of a single cavity or enveloping surface on the bracket facilitates and provides greater ease in the molding operation.

The concave surface 19 is also of a thickness which permits it to be compliant to allow application for various mounting shapes and diameters. A cross-sectional thickness of between about 100 and 300 mils, with a thickness of approximately 125 mils having been found appropriate to achieve sufficient compliance with the use of a material such as high density polyethylene. Such materials are available from Imperial Plastics Inc. of Lakeville, Minn., as well as from other commercial sources.

It will be appreciated that various modifications may be made in the structure illustrated herein without actually departing from the spirit and scope of the present invention.

What is claimed is:

1. In combination with a rotatable pinwheel mounted for rotation on a pinwheel shaft and means for activation by a stream of moving air, with the pinwheel shaft being coupled at its distal end to a support post; fastener means for joining said support post to a base member movable in the ambient air, said fastening means comprising:

(a) base bracket means comprising a "C"-shaped arcuate pad defining an inner concave base member contacting surface on a convex outer surface, and means including a plurality of radially extending ears for securely engaging a resilient flexible locking strap across said concave base member contacting surface;

(b) a resilient flexible locking strap having a body in the form of a generally rectangular sheet with ear hooking openings formed adjacent the edges thereof and adapted to be coupled across the edges of said "C"-shaped arcuate pad and to close the opening of said pad; and (c) a socket integral with said "C"-shaped arcuate pad and positioned on the convex outer surface thereof to retainably receive the proximal end of said support post therewithin.

2. The fastening means as defined in claim 1 wherein said resilient flexible locking strap is fabricated from rubber having a durometer of between 45 and 55.

3. The fastening means as defined in claim 1 wherein plural bores are arranged at spaced apart points in said generally rectangular sheet forming said resilient flexible locking strap for adjustable retention on said outwardly projecting ears.

4. The fastening means as defined in claim 1 wherein said radial extending locking ears project radially from the base of said arcuate pad.

5. The fastening means as defined in claim 1 wherein said mounting boss extends radially from the center of said arcuate pad.

6. In combination with a rotatable pinwheel mounted for rotation on a pinwheel shaft and means for activation by a stream of moving air, with the pinwheel shaft being coupled at its distal end to a support post; fastener means for coupling said support post to a base member movable in the ambient air, said fastening means comprising:

(a) base mounting pad means comprising a mounting surface engaging and contacting pad, said surface engaging and contacting pad including strap securing means with a plurality of projections thereon for securely engaging a resilient flexible locking strap across said surface engaging and contacting pad; and (b) a resilient flexible locking strap having a body with projection engaging openings formed adjacent the edges thereof and adapted to be coupled across the edges of said surface engaging and contacting pad and to close thereacross.

7. The combination as defined in claim 6 wherein said mounting surface engaging and contacting pad has a recess formed therein for engagement with a mounting surface.

8. The combination as defined in claim 6 wherein said resilient flexible locking strap is in the form of a generally rectangular sheet with openings formed therein for engaging said plurality of projections.

9. The combination as defined in claim 8 wherein said resilient flexible locking strap is fabricated from rubber having a durometer of between 45 and 55.

10. The combination as defined in claim 6 wherein said projections are formed at opposite ends of said surface engaging and contacting pad, and wherein the openings formed in said locking strap are designed to closely enclose and envelope said projections.

* * * * *